US005391956A

United States Patent [19]

Watanabe et al.

[11] Patent Number: 5,391,956

[45] Date of Patent: Feb. 21, 1995

[54] ELECTRON EMITTING DEVICE, METHOD FOR PRODUCING THE SAME AND DISPLAY APPARATUS AND ELECTRON BEAM DRAWING APPARATUS UTILIZING THE SAME

[75] Inventors: Nobuo Watanabe; Takeo Tsukamoto, both of Atsugi; Masahiko Okunuki, Tokyo, all of Japan

[73] Assignee: Canon Kabushiki Kaisha, Tokyo, Japan

[21] Appl. No.: 994,459

[22] Filed: Dec. 21, 1992

Related U.S. Application Data

[63] Continuation of Ser. No. 578,212, Sep. 6, 1990, abandoned.

[30] Foreign Application Priority Data

Sep. 7, 1989 [JP] Japan ..... 1-233937
Sep. 7, 1989 [JP] Japan ..... 1-233938
Dec. 11, 1989 [JP] Japan ..... 1-320823

[51] Int. Cl.[6] ..... H01J 1/30

[52] U.S. Cl. ..... 313/309; 313/336; 313/351

[58] Field of Search ..... 313/309, 310, 336, 351

[56] References Cited

U.S. PATENT DOCUMENTS 3,755,704 8/1973 Spindt et al. ..... 313/309
3,921,022 11/1975 Levine ..... 313/336
4,008,412 2/1977 Yuito et al. ..... 313/309
4,810,934 3/1989 Shimoda et al. ..... 315/107
4,825,082 4/1989 Okunuki et al. ..... 250/423
4,833,507 5/1989 Shimizu et al. ..... 357/4
4,894,611 1/1990 Shimoda et al. ..... 324/158
4,896,045 1/1990 Okunuki et al. ..... 250/492.2
4,904,895 2/1990 Tsukamoto et al. ..... 313/336
4,904,895 2/1990 Tsukamoto et al. ..... 313/336
4,940,916 7/1990 Borel et al. ..... 313/336
4,956,578 9/1990 Shimizu et al. ..... 315/3
4,964,946 10/1990 Gray et al. ..... 313/309

FOREIGN PATENT DOCUMENTS 62-229151 7/1987 Japan .
0851543 7/1981 U.S.S.R. .
WO 8909479 10/1989 WIPO .

OTHER PUBLICATIONS

"Novel type of emissive flat panel display: the matrixed cold-cathode microtip fluorescent display," G. Labrunie et al., Displays, IPC Science & Technology Press, U.K. Jan. 1987 pp. 37–40.

"Physical properties of thin-film field emission cathodes with molybenum cones," C. A. Spindt et al., Journal of Applied Physics, vol. 47, No. 12, Dec. 1976, pp. 5248–5163.

Journal of Applied Physics, vol. 39, No. 7, Jun. 1968, pp. 3504–3505.

*Primary Examiner*—Donald J. Yusko
*Assistant Examiner*—N. D. Patel
*Attorney, Agent, or Firm*—Fitzpatrick, Cella, Harper & Scinto

[57] ABSTRACT

An electron emitting device with an insulating layer on a substrate. The insulating layer has a hollow part in which a conical electrode is formed. A conductive layer on the insulating layer has an aperture on the hollow part of the insulating layer. The hollow part is formed by etching utilizing an ion beam.

22 Claims, 9 Drawing Sheets

ELECTRON EMITTING DEVICE, METHOD FOR PRODUCING THE SAME AND DISPLAY APPARATUS AND ELECTRON BEAM DRAWING APPARATUS UTILIZING THE SAME

This application is a continuation of application Ser. No. 07/578,212, filed Sep. 6, 1990, now abandoned.

BACKGROUND OF THE INVENTION

1. Field of the Invention

The present invention relates to an electron emitting device, a method for producing the same, and a display apparatus and an electron beam drawing apparatus utilizing said electron emitting device.

2. Related Background Art

Conventionally used electron emitting devices are mostly those utilizing a hot cathode, but the electron emission by the hot cathode has been associated with drawbacks such as a large energy loss by heating and the necessity for preliminary heating.

For resolving these drawbacks there have been proposed various electron emitting devices of cold cathode type, including a field effect type electron emitting device in which a high electric field is locally generated and the electron emission is realized by field emission.

FIG. 1 is a schematic partial cross-sectional view showing an example of such field effect electron emitting device, and FIGS. 2A to 2D are schematic views showing the steps for producing said device.

As shown in FIG. 1, said field effect electron emitting device is composed of a substrate 101 composed for example of Si; a point-shaped electron emitting part 108 composed for example of molybdenum (Mo) and formed on said substrate; an insulating layer 102 composed for example of $SiO_2$ and having an aperture around said point-shaped electron emitting part 108; and an electrode 109 the end of which is positioned close to the pointed part of the conical shape.

In such electron emitting device, electrons are emitted from the pointed part where the intensity of electric field is strong, when a voltage is applied between the substrate 101 and the electrode 109.

Such field effect electron emitting device utilizing microfabrication technology is for example reported by C. A. Spindt et al. in Journal of Applied Physics, Vol. 47, No. 12, 1976, p. 5246. Said electron emitting device is obtained by forming a hole of a diameter of about 1.5 μm in a thin film of $SiO_2$ and a gate electrode formed in succession on a Si substrate, and further forming, by metal deposition, a conical emitter electrode with a diameter of the pointed end not exceeding 1000Å for field emission.

The above-mentioned electron emitting device is generally prepared by the following process;

(1) First, as shown in FIG. 2A, an insulating layer 102 for example of a $SiO_2$ film of a thickness of 1–1.2 μm is formed on the substrate 101 composed for example of Si.

(2) Then, on said insulating layer 102, a Mo layer 109 of a thickness for example of about 0.4 μm is formed for example by electron beam evaporation.

(3) An electron beam resist, composed for example of PMMA (polymethylmethacrylate) is applied by spin coating on said Mo layer 109.

(4) Said electron beam resist is irradiated with an electron beam in a desired pattern, and is then partially removed for example with isopropyl alcohol according to said desired pattern.

(5) The Mo layer 109 is selectively etched according to the resist pattern, to form a first aperture 103.

(6) Then the remaining electron beam resist is completely removed, and the insulating layer 102 is etched with hydrofluoric acid to form a second aperture 704 (FIG. 2A).

(7) Then the substrate 101 is rotated about an axis X with an inclination by a predetermined angle $\theta$, and aluminum is deposited by evaporation onto the Mo layer 109, thereby forming an Al layer 105. Since aluminum is deposited also on the lateral face of the Mo layer 109, the diameter of the first aperture 103 can be arbitrarily reduced by the control of amount of evaporation (FIG. 2B).

Subsequently Mo is deposited for example by electron beam evaporation perpendicularly to the substrate 101. Since Mo is deposited not only on the Al layer 105 and the substrate 101 but also on the lateral face of the Al layer 105, the diameter of the first aperture 103 decreases gradually with the deposition of a Mo layer 106. As the area of deposition of Mo on the Si substrate decreases according to the decrease in the diameter of said first aperture 103, there is a substantially formed conical electrode 108 on the substrate 101 (FIG. 2C).

Finally the field effect electron emitting device is obtained by removing the Mo layer 106 and the Al layer 105, as shown in FIG. 8D.

It is however difficult, in the above-explained process, to prepare a smaller field effect electron emitting device, for example the device smaller than 3 μm, with a high production yield, since the formation of the field forming space and the electron emitting part involves complicated technology such as oblique evaporation.

Also in the above-explained process for producing the electron emitting device, since the formation of the conical emitter electrode 108 is achieved by metal deposition, utilizing the shape of the aperture 103 in the Al layer 109, the reproducibility of the shape (height, angle, bottom diameter etc.) of said emitter electrode 108 is low, resulting in poor production yield and unsatisfactory uniformity of the shape or performance of the device. The production yield is particularly poor when plural electron emitting devices are formed at the same time on a Si substrate, resulting in a high cost. Since this tendency becomes more marked as the size of the electron emitting device becomes smaller, it has been difficult to obtain finer electron emitting devices.

Further, the manufacturing process of the above-explained conventional electron emitting device is very complex, resulting in the high cost of the device.

SUMMARY OF THE INVENTION

In consideration of the foregoing, an object of the present invention is to provide an electron emitting device allowing manufacture of a smaller size and with a high yield.

Another object of the present invention is to provide an electron emitting device allowing manufacture at a lower cost.

Still another object of the present invention is to provide a display apparatus and an electron beam drawing apparatus utilizing electron emitting devices enabling manufacture of a smaller size and an arrangement at a higher density with a lower cost.

Still another object of the present invention is to provide an electron emitting device which is excellent in reproducing the shape of the emitter electrode and enabling manufacture in a simple process, and a display apparatus and an electron beam drawing apparatus utilizing said electron emitting device.

Still another object of the present invention is to provide an electron emitting device comprising a substrate; an insulating layer formed thereon and having a hollow part therein; a substantially conical electrode formed in said hollow part; and a conductive layer formed on said insulating layer and having an aperture above said hollow part, wherein said hollow part is formed by ion beam etching.

Still another object of the present invention is to provide a field emission type electron emitting device formed by:

irradiating the surface of a substrate of an insulating material with a focused ion beam along an arbitrary circle defined on said surface, thereby forming an ion implanted area in said substrate;

chemically etching said substrate to eliminate said ion implanted area thereby forming an electric field forming space having a projection at the bottom thereof;

covering said projection with a conductive material to form a point-shaped electron-emitting part; and covering the surface of said substrate, excluding said electric field forming space, with a conductive material thereby forming an electrode for forming an electric field in cooperation with said point-shaped electron emitting part.

Still another object of the present invention is to provide a field emission type electron emitting device formed by:

irradiating the surface of a substrate composed of a semiconductive or conductive material having a surfacial insulating layer with a focused ion beam along an arbitrary circle defined on said surface, thereby forming an ion implanted area in said substrate;

chemically etching said substrate to eliminate said ion implanted area thereby forming an electric field forming space having a projection at the bottom thereof;

covering said projection with a conductive material to form a point-shaped electron emitting part; and covering the surface of said substrate, excluding said electric field forming space, with a conductive material thereby forming an electrode for forming an electric field in cooperation with said point-shaped electron emitting part.

Still another object of the present invention is to provide a field emission type electron emitting device formed by:

irradiating the surface of a substrate composed of an insulating material with a focused ion beam along an arbitrary race track-shaped trajectory defined on said surface, thereby forming an ion implanted area in said substrate;

chemically etching said substrate to eliminate said ion implanted area thereby forming an electric field forming space having a line-shaped projection at the bottom thereof;

covering said line-shaped projection with a conductive material to form a line-shaped electron emitting part; and covering the surface of said substrate, excluding said electric field forming space, with a conductive material thereby forming an electrode for forming an electric field in cooperation with said line-shaped electron emitting part.

Still another object of the present invention is to provide a field emission type electron emitting device formed by:

irradiating the surface of a substrate composed of a semiconductive or conductive material having a surfacial insulating layer with a focused ion beam along an arbitrary race track-shaped trajectory defined on said surface, thereby forming an ion implanted area in said substrate;

chemically etching said substrate to eliminate said ion implanted area thereby forming an electric field forming space having a line-shaped projection at the bottom thereof;

covering said line-shaped projection with a conductive material to form a line-shaped electron emitting part; and covering the surface of said substrate, excluding said electric field forming space, with a conductive material thereby forming an electrode for forming an electric field in cooperation with said line-shaped electron emitting part.

Still another object of the present invention is to provide a method for producing an electron emitting device, comprising the steps of:

irradiating a substrate with an ion beam in a desired pattern;

etching said substrate irradiated with said ion beam for eliminating at least the part irradiated by said ion beam; and depositing a conductive material on said etched substrate.

The foregoing objects can be attained, according to a preferred embodiment of the present invention, by an electron emitting device comprising at least a substrate; an insulating layer formed thereon and having a hollow part therein; a substantially conical electrode formed in said hollow part; and a conductive layer formed on said insulating layer and having an aperture above said hollow part, wherein said hollow part is formed by etching utilizing an ion beam.

The foregoing objects can be attained, according to another preferred embodiment of the present invention, by an electron emitting device formed by:

irradiating the surface of a substrate of an insulating material with a focused ion beam along an arbitrary circle defined on said surface, thereby forming an ion implanted area in said substrate;

chemically etching said substrate to eliminate said ion implanted area thereby forming an electric field forming space having a projection at the bottom thereof;

covering said projection with a conductive material to form a point-shaped electron emitting part; and covering the surface of said substrate, excluding said electric field forming space, with a conductive material thereby forming an electrode for forming an electric field in cooperation with said point-shaped electron emitting part.

The foregoing objects can be attained, according to still another preferred embodiment of the present invention, by an electron emitting device formed by:

irradiating the surface of a substrate composed of an insulating material with a focused ion beam along an arbitrary race track-shaped trajectory defined on said surface, thereby forming an ion implanted area in said substrate;

chemically etching said substrate to eliminate said ion implanted area thereby forming an electric field forming space having a line-shaped projection at the bottom thereof;

covering said line-shaped projection with a conductive material to form a line-shaped electron emitting part; and covering the surface of said substrate, excluding said electric field forming space, with a conductive material thereby forming an electrode for forming an electric field in cooperation with said line-shaped electron emitting part.

DETAILED DESCRIPTION OF THE PREFERRED EMBODIMENTS

Figure 1:
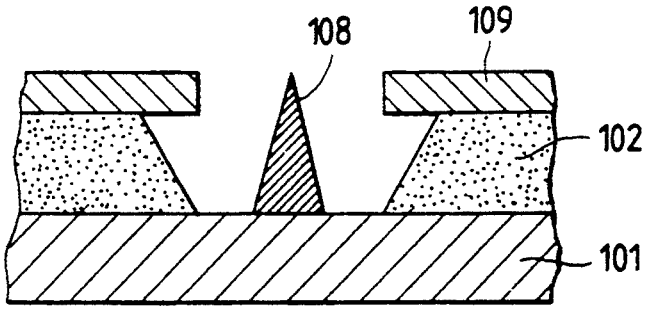
FIG. 1 PRIOR ART
FIG. 1 is a schematic partial cross-sectional view of an example of the conventional field emission type electron emitting device.
Figure 2A:
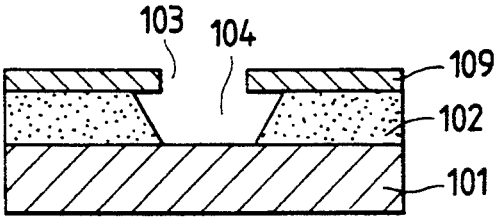
FIG. 2A PRIOR ART
FIGS. 2A, 2B, 2C and 2D are schematic views showing steps of a method for producing the field emission type electron emitting device shown in FIG. 1.
Figure 2B:
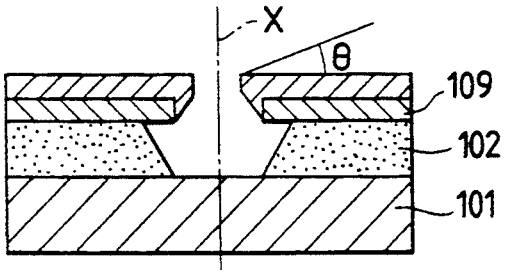
FIG. 2B PRIOR ART
Figure 2C:
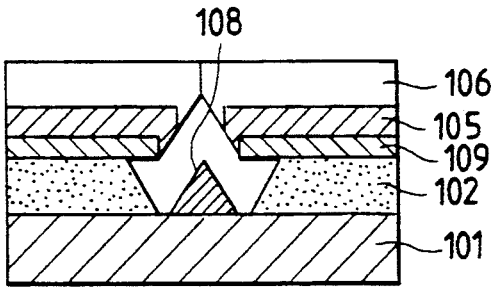
FIG. 2C PRIOR ART
Figure 2D:
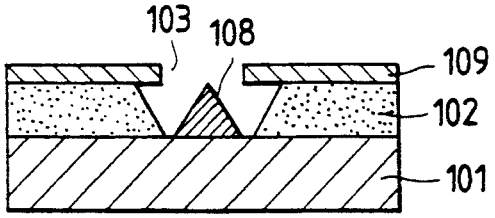
FIG. 2D PRIOR ART

The aforementioned objects can be attained, according to a preferred embodiment of the present invention, by an electron emitting device comprising at least a substrate; an insulating layer formed thereon and having a hollow part therein; a substantially conical electrode formed in said hollow part; and a conductive layer formed on said insulating layer and having an aperture above said hollow part, wherein said hollow part is formed by etching utilizing an ion beam.

In said electron emitting device, said insulating layer may be provided with plural hollow parts respectively provided with said ,substantially conical electrodes, and said conductive layer may be provided with plural apertures respectively corresponding to said plural hollow parts.

Said ion beam is preferably a focused ion beam (FIB).

Also said conical electrode and said conductive layer are preferably formed at the same time.

The above-mentioned electron emitting device is naturally applicable to a display apparatus or an electron beam drawing apparatus.

Also the aforementioned objects can be attained, according to another preferred embodiment of the present invention, by an electron emitting device formed by:

irradiating the surface of a substrate of an insulating material with a focused ion beam along an arbitrary circle defined on said surface, thereby forming an ion implanted area in said substrate;

chemically etching said substrate to eliminate said ion implanted area thereby forming an electric field forming space having a projection at the bottom thereof;

covering said projection with a conductive material to form a point-shaped electron emitting part; and covering the surface of said substrate, excluding said electric field forming space, with a conductive material thereby forming an electrode for forming an electric field in cooperation with said point-shaped electron emitting part.

Also the aforementioned objects can be attained, according to still another preferred embodiment of the present invention, by an electron emitting device formed by:

irradiating the surface of a substrate of a semiconductive or conductive material having a surfacial insulating layer with a focused ion beam along an arbitrary circle defined on said surface, thereby forming an ion implanted area in said substrate;

chemically etching said substrate to eliminate said ion implanted area thereby forming an electric field forming space having a projection at the bottom thereof;

covering said projection with a conductive material to form a point-shaped electron emitting part; and covering the surface of said substrate, excluding said electric field forming space, with a conductive material thereby forming an electrode for forming an electric field in cooperation with said point-shaped electron emitting part.

In said electron emitting device, said insulating layer is preferably formed by vacuum evaporation.

Also said point-shaped electron emitting part is preferably formed by vacuum evaporation.

Furthermore, said electrode is also preferably formed by vacuum evaporation.

Furthermore, said point-shaped electron emitting part and said electrode are preferably formed at the same time by vacuum evaporation.

The depth and shape of said electric field forming space may be controlled by the accelerating voltage of said focused ion beam, amount of implanted ions and/or kind of implanted ions.

Furthermore, there is preferably applied a treatment for reducing the work function of said point-shaped electron emitting part.

Furthermore, the work function of said point-shaped electron emitting part is reduced preferably by covering the surface of said point-shaped electron emitting part with a material of a lower work function than that of said substrate.

Said electric field forming space and said point-shaped electron emitting part may be formed in plural numbers on a single substrate.

The aforementioned objects can be attained, according to still another preferred embodiment of the present invention, by an electron emitting device formed by:

irradiating the surface of a substrate composed of an insulating material with a focused ion beam along an arbitrary race track-shaped trajectory defined on said surface, thereby forming an ion implanted area in said substrate;

chemically etching said substrate to eliminate said ion implanted area thereby forming an electric field forming space having a line-shaped projection at the bottom thereof;

covering said line-shaped projection with a conductive material to form a line-shaped electron emitting part; and covering the surface of said substrate, excluding said electric field forming space, with a conductive material thereby forming an electrode for forming an electric field in cooperation with said line-shaped electron emitting part.

Furthermore, the aforementioned objects can be attained, according to still another preferred embodiment of the present invention, by an electron emitting device formed by:

irradiating the surface of a substrate composed of a semiconductive or conductive material having a surfacial insulating layer with a focused ion beam along an arbitrary race track-shaped trajectory defined on said surface, thereby forming an ion implanted area in said substrate;

chemically etching said substrate to eliminate said ion implanted area thereby forming an electric field forming space having a line-shaped projection at the bottom thereof;

covering said line-shaped projection with a conductive material to form a line-shaped electron emitting part; and covering the surface of said substrate, excluding said electric field forming space, with a conductive material thereby forming an electrode for forming an electric field in cooperation with said line-shaped electron emitting part.

Also in these devices, said insulating layer may be formed by vacuum evaporation.

Also said line-shaped electron emitting part may be formed by vacuum evaporation.

Furthermore, said electrode may be formed by vacuum evaporation.

Naturally said line-shaped electron emitting part and said electrode may be formed by vacuum evaporation at the same time.

Furthermore, the depth and shape of said electric field forming space can be controlled by the accelerating voltage of said focused ion beam, amount of implanted ions and/or kind of implanted ions.

Also as explained in the foregoing, there is a treatment preferably applied for reducing the work function of said line-shaped electron emitting part.

Likewise, the work function of said line-shaped electron emitting part is reduced preferably by covering the surface of said line-shaped electron emitting part with a material of a lower work function than that of said substrate.

Also in these devices, said electric field forming space and said line-shaped electron emitting part may be formed in plural number on a single substrate.

Furthermore the aforementioned objects can be attained, according to the present invention, by a method for producing an electron emitting device comprising the steps of:

irradiating a substrate with an ion beam in a desired pattern;

etching said substrate irradiated with said ion beam, thereby at least eliminating an area irradiated with said ion beam; and depositing a conductive material on said etched substrate.

In the above-mentioned method, said substrate may be a semiconductive substrate having an insulating layer formed thereon.

In such case, said semiconductive substrate is preferably composed of GaAs or Si.

Furthermore, the above-mentioned semiconductive substrate may be composed of an insulating substrate having a semiconductive layer formed thereon.

Said insulating layer is preferably composed of a material selected from $SiO_2$, semiconductive Si, $Si_3N_4$ and AlS.

Also said conductive material is preferably selected from W, Mo, Ta, Ti and Pt.

The above-mentioned method preferably contains an additional step depositing a material of a low work function.

Said material of low work function is preferably a boride or a carbide.

Said boride is preferably selected from $LaB_6$ and $SmB_6$.

Also said carbide is preferably selected from TiC and ZrC.

Also the substrate in the above-mentioned method preferably comprises a crystalline material, which is preferably a monocrystalline or polycrystalline material.

Said crystalline material is advantageously selected from Si, Ge, yttrium-aluminum garnet (YAG), yttrium-iron garnet (YIG) and GaAs.

Also in the above-mentioned method, the irradiation with said ion beam may be conducted along the periphery of a circle having the center at a desired position, or along the periphery of a race track shape having linear positions between two circles having centers at desired positions.

Thus the present invention produces an electron emitting device by irradiating a predetermined position of a crystalline material with a focused ion beam thereby forming an ion implanted area, and chemically etching said material to eliminate a predetermined portion of said ion implanted area thereby forming an electric field forming space.

Also the present invention greatly simplifies the method for producing the electron emitting device and drastically improves the reproducibility of the shape of the emitter, by forming an aperture in the insulating layer by means of maskless etching utilizing the ion beam.

The present invention will be clarified in greater detail in the following description.

It is well known that irradiation of a Si or GaAs single crystal with an ion beam of Be, Si or Au with an intensity of $10^{14}$ ions/cm$^2$ or higher converts said single crystal into an amorphous state, whereby the irradiated portion shows an increased etching rate and can be selectively etched after the ion implantation. Such etching method is usable also on $SiO_2$ crystal. Such etching method combined with focused ion beam technology forms a fine hole with a high precision.

Figure 3:
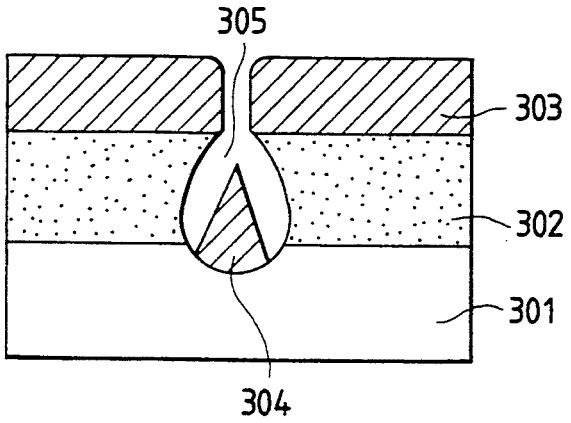
FIG. 3 is a schematic cross-sectional view of an electron emitting device constituting a first embodiment of the present invention.

The cross-sectional shape of the hole formed by such etching is determined by the scattered distribution of the implanted ions, and assumes the form of a waterdrop as shown in FIG. 3.

The present invention utilizes the hole of such waterdrop form obtained by scattering of the implanted ions, for the preparation of a field emission type electron emitting device.

1st embodiment

FIG. 3 is a schematic cross-sectional view showing an electron emitting device constituting a preferred embodiment of the present invention. Shown are an n-GaAs (semiconductive) substrate 301; an epitaxially grown $SiO_2$ layer 302, serving as an insulating layer, of a thickness of 0.5 μm; a tungsten gate electrode 303 of a thickness of 0.4 μm; an emitter 304; and a hole 305 formed by etching utilizing the focused ion beam technology.

The emitter 304 has a diameter of several hundred Angstroms at the pointed end, and is capable of emitting current of about 1 nA by the application of a voltage of 20 V or higher between the substrate 301 and the gate electrode 203.

Figure 4A:
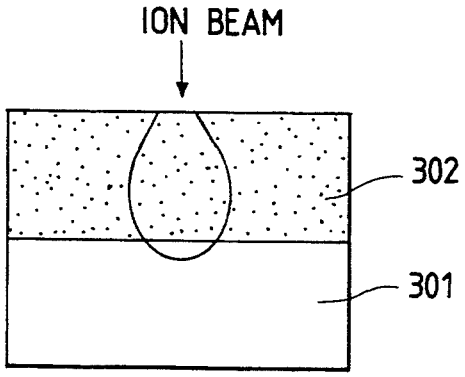
FIGS. 4A, 4B and 4C are schematic cross-sectional views showing steps of a method for producing the electron emitting device shown in FIG. 3.
Figure 4B:
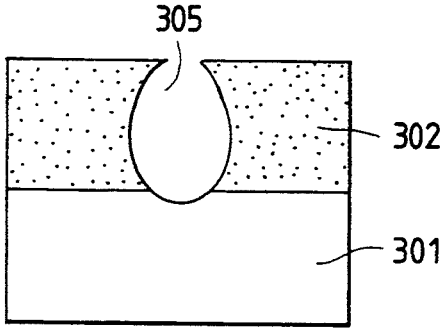
Figure 4C:
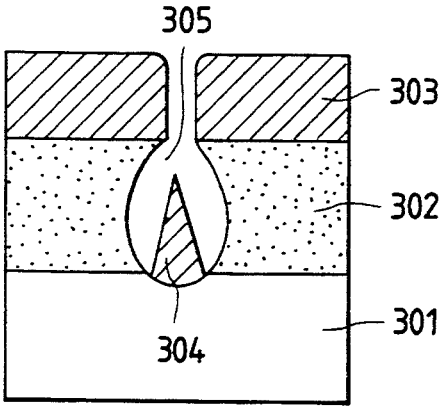

In the following, the process for producing the electron emitting device of the present invention will be explained. FIGS. 4A–4C are schematic cross-sectional views showing the steps of a process for producing the electron emitting device shown in FIG. 3.

(1) First, on the n-GaAs substrate 301, the $SiO_2$ insulating layer 302 of a thickness of 0.5 μm was formed by epitaxial growth.

(2) Then, the $SiO_2$ layer 302 was irradiated with an ion beam of 200 keV with a dose of $10^{16}$ ions/cm$^2$, focused to a diameter of 0.1 μm, as shown in FIG. 4A.

(3) Subsequently the $SiO_2$ layer 302 was treated with heated acid to selectively etch the area implanted with the ion beam in the step (2), thereby obtaining a hole 305 of waterdrop form as shown in FIG. 4B.

(4) Then, on the $SiO_2$ layer 302, tungsten was deposited with a thickness of 0.4 μm by sputtering to form the gate electrode 303 and the emitter 304 as shown in FIG. 4C is thereby provided at the concave bottom of the waterdrop (teardrop) shaped hollow part, and, whereby the electron emitting device as shown in FIG. 3 was completed.

Thus the electron emitting device of the present embodiment can be prepared by an extremely simple process, in comparison with the process for the conventional device. Also the yield can be improved since the reproducibility of the shape of the emitter 304 is improved in comparison with the conventional process. Also since the precision of the shape of the emitter 304 can be improved, it becomes easier to form the emitter 304 in a smaller size than in the conventional technology., and it renders possible to obtain an electron emitting device capable of electron emission with a voltage lower than in the conventional devices.

The substrate 301, which is composed of GaAs in the present embodiment, may also be composed of Si. Furthermore the substrate 301 may be composed for example of a glass substrate and amorphous silicon formed thereon, or an insulating substrate and a semiconductor epitaxially grown thereon, for example by SOI (silicon on insulator) technology. Also the $SiO_2$ layer may be replaced by a layer of semiconductive Si, $Si_3N_4$ or AlS. Also the gate electrode may be composed of Mo, Ta, Ti, Pt etc. instead of W.

2nd embodiment

Figure 5:
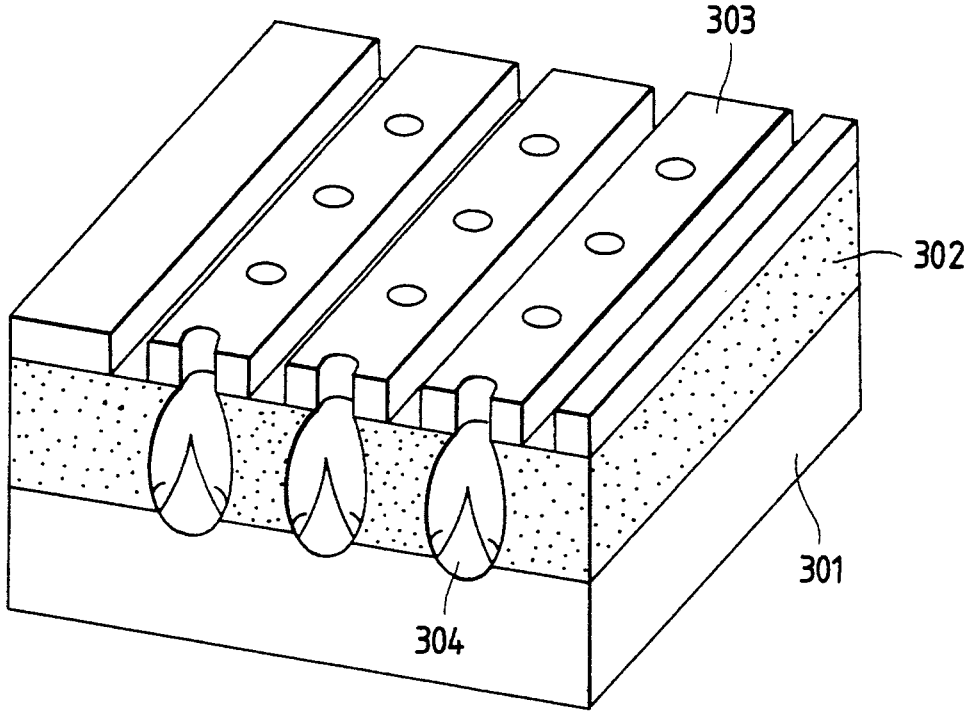
FIG. 5 is a schematic perspective view of an electron emitting device constituting a second embodiment of the present invention.

FIG. 5 is a perspective view of an electron emitting device constituting another preferred embodiment of the present invention, wherein plural electron emitting devices are linearly arranged on a single substrate.

The present invention, being capable of improving the production yield of each electron emitting device, is particularly effective when plural electron emitting devices are formed on a single substrate as in the present embodiment.

3rd embodiment

Figure 6:
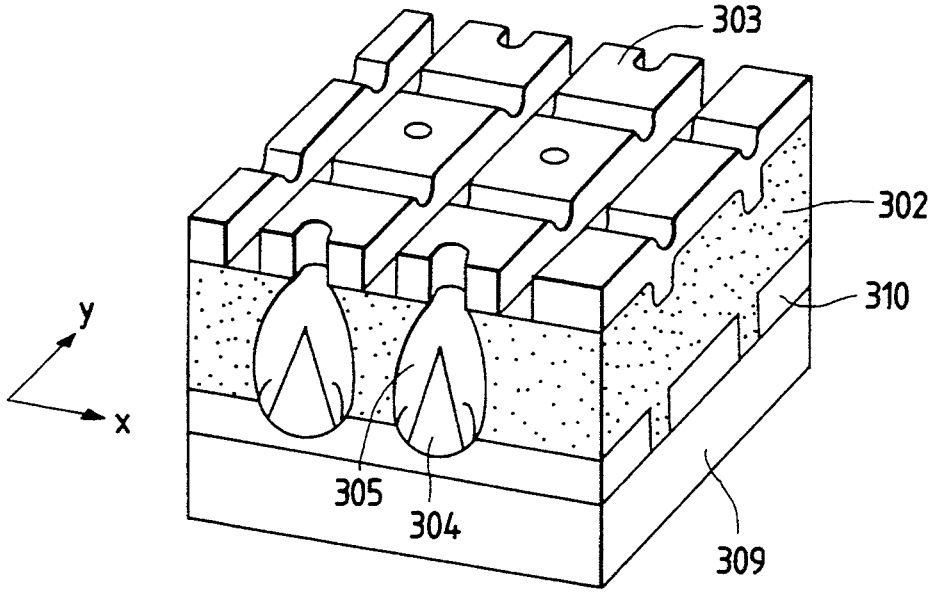
FIG. 6 is a schematic perspective view of an electron emitting device constituting a third embodiment of the present invention.

FIG. 6 is a perspective view of an electron emitting device constituting another preferred embodiment of the present invention, wherein plural electron emitting devices are arranged in a matrix on a single substrate.

The electron emitting device of the present embodiment is prepared by forming, on an insulating substrate 309, a Ni metal film of a thickness of 1 μm in a linear form as a substrate electrode 310, then forming an insulating layer 302 for example of SiO on said substrate electrode 310, and forming a linear gate electrode 303 perpendicularly to the substrate electrode 310.

The present invention, being easily capable of improving the precision of the shape of the emitter 304, permits reducing the dimension of the electron emitting device and arranging such devices in a higher density. More specifically, since the hole 305 can be formed with a size of 0.5 μm or smaller, the electron emitting devices can be arranged in a matrix with a pitch as small as about 1 μm.

In the present embodiment each element is provided with an emitter, but it is also possible to form plural emitters in each element, and such structure allows obtaining a two-dimensional electron beam of a large current.

As explained in the foregoing, the present embodiment provides an electron emitting device of a simple structure with a larger freedom in size, which can be widely employed in appliances utilizing electron beam.

For example, in the field of display, it can be utilized as an electron source for a cathode ray tube or a flat panel display, or as an electron emitting device for a flat image pickup tube.

Industrially, it can be utilized as the electron emitting device for an electron beam drawing apparatus for semiconductor device manufacture, utilizing the features of the present invention such as a large current and a high device density. For example, the electron emitting device of the present invention may be employed instead of the $LaB_6$ conventionally used in such apparatus. Also utilizing the feature of high density arrangement of the present invention, the device may be provided with emitters arranged one-dimensionally or two-dimensionally and may be positioned parallel to the wafer, thereby achieving a high speed pattern drawing.

4th embodiment

FIGS. 7A to 7D are schematic cross-sectional views while FIGS. 7E to 7H are schematic perspective views, showing the method for producing the field emission type electron emitting device of the present embodiment. The cross-sectional views in FIGS. 7A to 7D respectively correspond to lines A—A in FIGS. 7E to 7H. A substrate 701 can be composed of an insulating single crystal such as yttrium-iron garnet (YIG) or yttrium-aluminum garnet (YAG), but YIG with crystal orientation (111) is employed in the present embodiment.

Figure 7A:
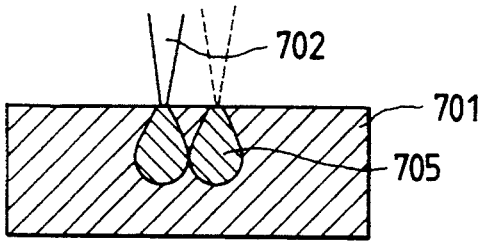
FIGS. 7A, 7B, 7C, 7D, 7E, 7F, 7G and 7H are schematic cross-sectional and perspective views of a field emission type electron emitting device constituting a fourth embodiment of the present invention.
Figure 7B:
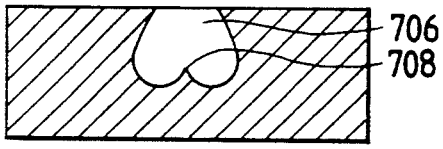
Figure 7C:
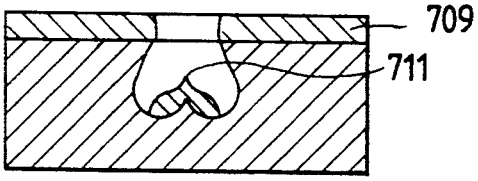
Figure 7D:
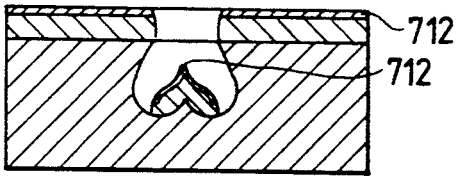
Figure 7E:
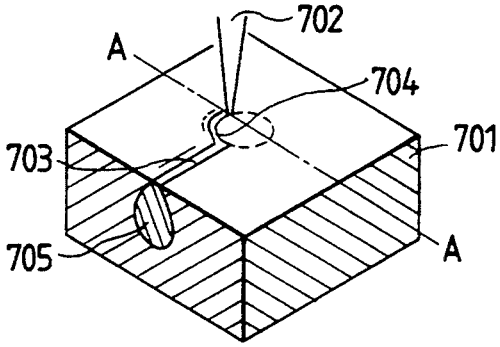

(1) At first the YIG substrate was subjected to ion implantation with a $Be^{2+}$ ion beam of 160 keV focused to a spot of 0.1 μmϕ or smaller as shown in FIGS. 7A and 7E. The ion dose was $4\times10^{16}$ ions/cm$^2$ in an area for forming the wiring electrode space (703), and $2\times10^{16}$ ions/cm$^2$ in an area for forming the electric field forming space (704). The ion implantation for forming the electric field forming space was conducted along a circle of 0.4 μmϕ around a desired position. The implanted Be ions were scattered in the substrate 701, thus forming a waterdrop-shaped implanted area 705 as shown in FIG. 7A.

Figure 7F:
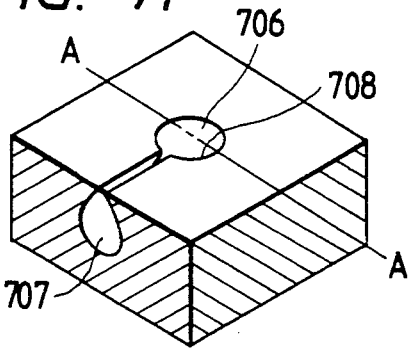

(2) Then the substrate was immersed in phosphoric acid at room temperature to selectively etch off said implanted area, thereby forming, as shown in FIGS. 7B and 7F, an electric field forming space 706, an electrode wiring space 707 and a pointed projection 708 at a depth of 0.5 μm from said desired position on the surface of the substrate.

Figure 7G:
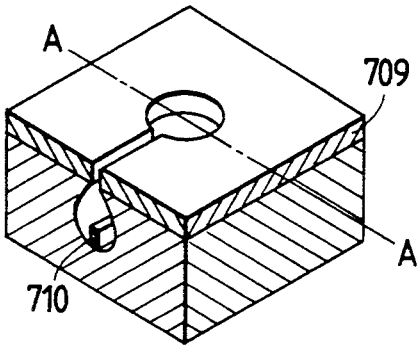

(3) Subsequently tungsten was perpendicularly deposited by vacuum evaporation in a thickness of 0.2 μm on the surface of the substrate, thereby simultaneously forming an electrode 709, a wiring and a point-shaped electron emitting part 711 as shown in FIGS. 7C and 7G.

In this state an electron emission of 50 μA or higher was obtained by a voltage application of 30 V between the wiring 710 and the electrode 709.

Figure 7H:
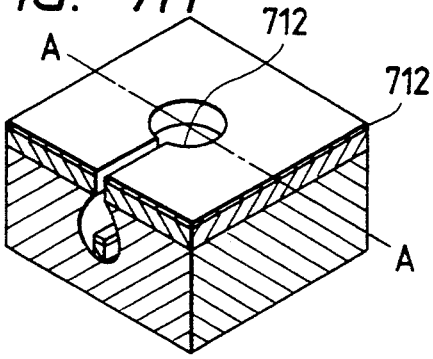

(4) For improving the electron emitting characteristics of this device, $LaB_6$ 712, as a material of low work function, was perpendicularly deposited by vacuum evaporation in a thickness of 200Å on the surface of the substrate 701, as shown in FIGS. 7D and 7H.

The field emission type electron emitting device thus completed showed electron emission of 100 μA or higher from the point-shaped electron emitting part, by a voltage application of 25 V between the electrode wiring and the electrode. Thus the surface coverage with a material of low work function reduced the required voltage or increased the emission current at a same voltage. In addition to $LaB_6$, said material of low work function can for example be borides such as $SmB_6$ or carbides such as TiC or ZrC.

Figure 8:
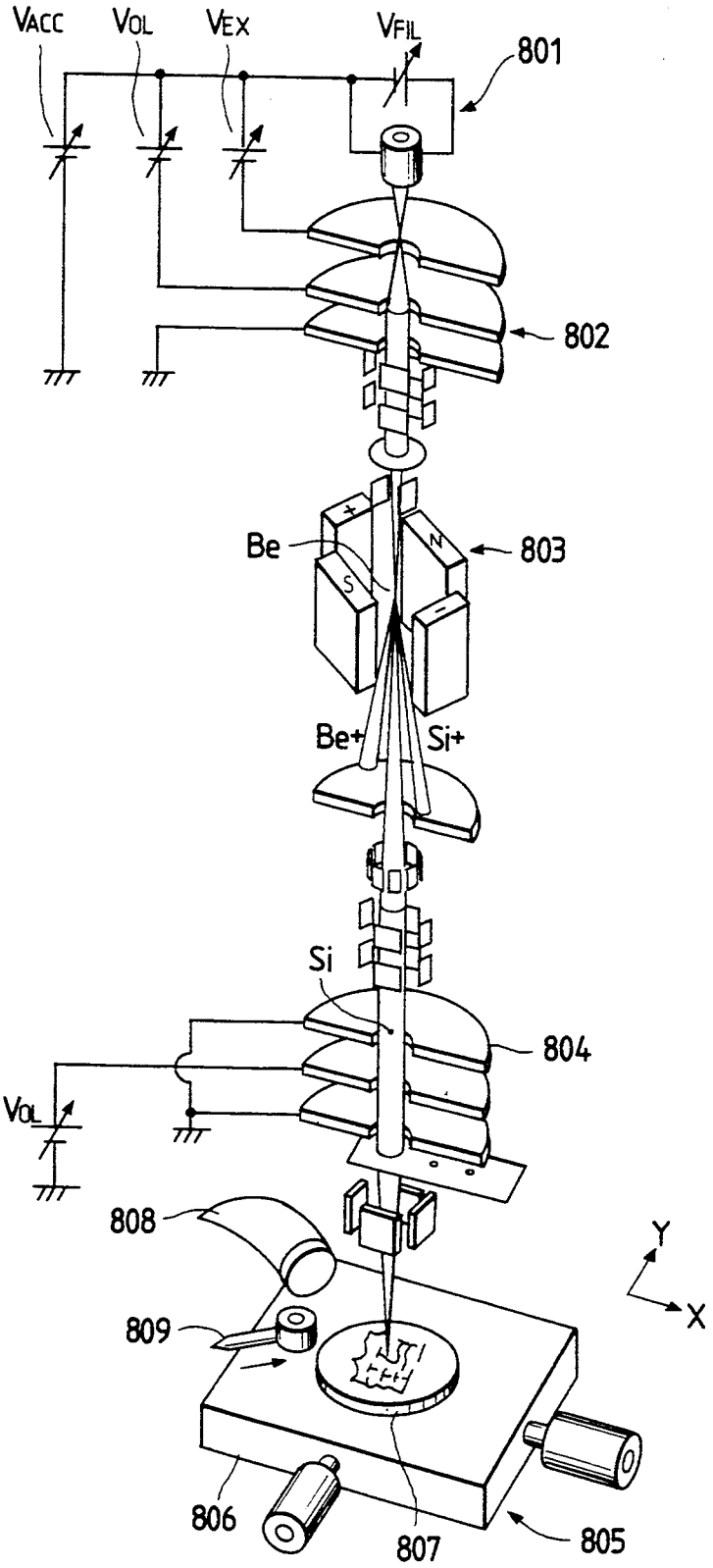
FIG. 8 is a schematic view of a concentrated ion beam scanning apparatus employed in the preparation of the device of the present invention.

FIG. 8 schematically shows an ion beam scanning apparatus employed in the ion beam irradiation mentioned above.

In the following, the operating method of ion beam with said will be explained.

(1) An ion beam which is field emitted from an Au—Si—Be liquid metal ion source 801 is focused by an electric condenser lens 802, and a necessary species is separated by an E×B mass separator 803.

(2) Then the beam is again focused by an objective lens 804, and is deflected toward a target 807 under computer control.

(3) The target 807 is set at a desired position by movement in the X-Y plane, by a stage 806 moved by a stage unit 806.

In FIG. 8 there are also shown a SEI 808 and a Faraday cup 809.

The ion implantation with the apparatus shown in FIG. 8 can be conducted with an accelerating voltage of 40–80 kV and a beam diameter of 0.1 μm, for example in case of implanting Si or Be ions perpendicularly into the (111) plane of YIG substrate.

Figure 9:
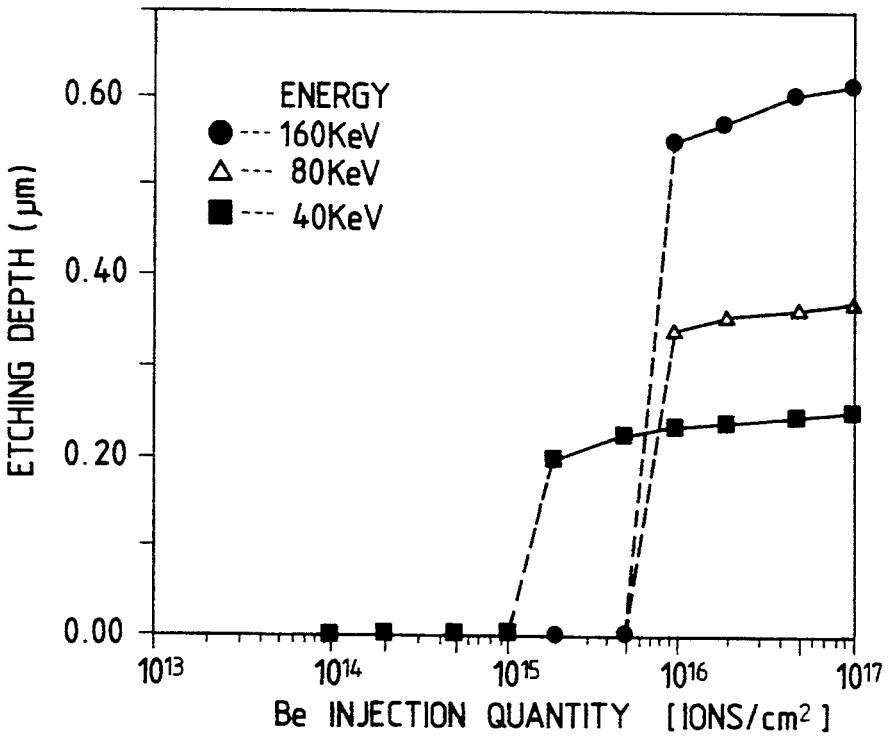
FIGS. 9 and 10 are charts showing the etch depth as a function of the amount of ion implantation.
Figure 10:
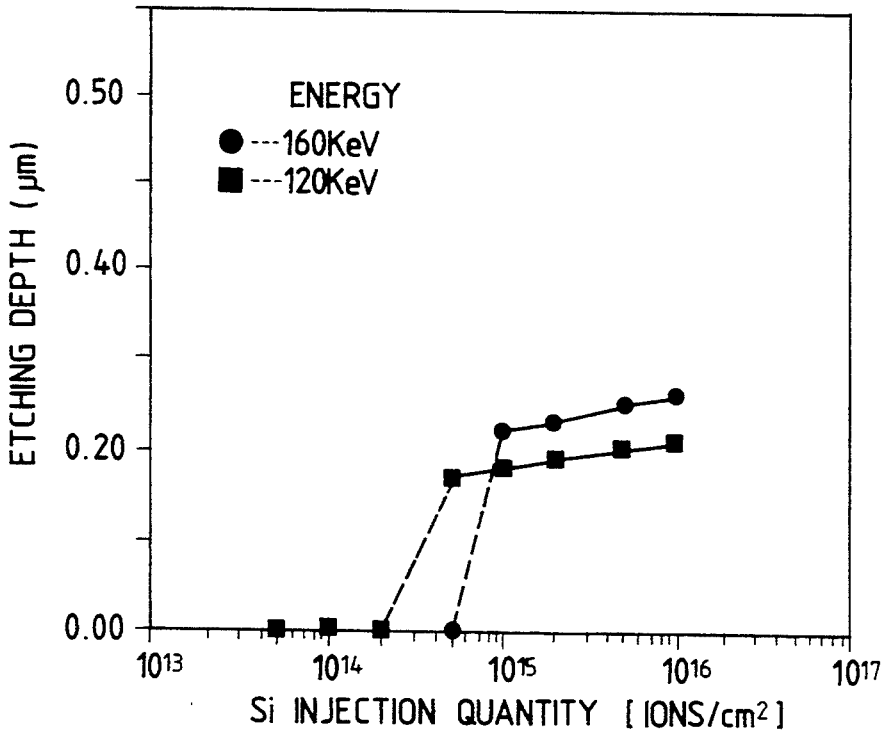

FIGS. 9 and 10 show the etch depth obtained by implanting Be or Si ions with different doses or accelerating voltages and etching a predetermined portion at the implanted area with phosphoric acid of room temperature.

As will be understood from these charts, the size of the electric field forming space and the electrode wiring space can be arbitrarily selected by the accelerating voltage of the focused ion beam, dose of ions and species of ions.

5th embodiment

FIGS. 11A to 11E are schematic cross-sectional views showing the method for producing a field emission type electron emitting device employing N—GaAs semiconductor single crystal doped with Si at $3\times10^{18}$ ions/cm$^2$ as the substrate.

Figure 11A:
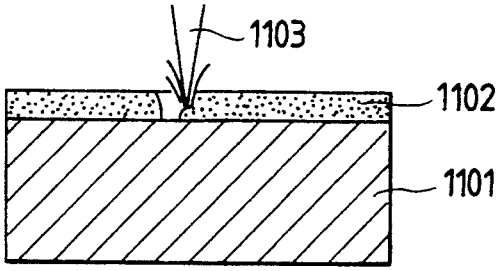
FIGS. 11A, 11B, 11C, 11D and 11E are schematic cross-sectional views showing the method for producing the electron emitting device of fifth and eighth embodiments.

(1) At first, a $SiO_2$ film 1102 of a thickness of 0.2 μm, formed by vacuum evaporation on a substrate 1101 as shown in FIG. 11A, was irradiated with an $Au^{2+}$ ion beam 1103 of 80 keV with a dose of $8\times10^{18}$ ions/cm$^2$, focused to a diameter of 0.1 μmϕ, inside a circle of 0.4 μmϕ around a desired position, and was thus removed by sputter-etching.

Figure 11B:
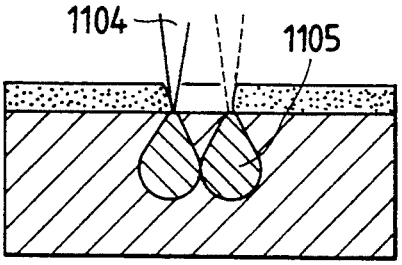

(2) Then, as shown in FIG. 11B, the substrate was irradiated with a $Si^{2+}$ ion beam 1104 of 160 keV focused to a diameter of 0.1 μmϕ along a circle of 0.35 μmϕ around said desired position with a dose of $2\times10^{16}$ ions/cm$^2$ to form a waterdrop-shaped implanted area 1105.

Figure 11C:
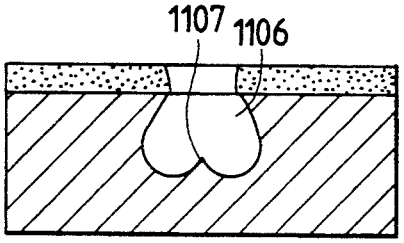

(3) Then the substrate was immersed in hydrochloric acid heated to 70° C. to selectively etch off the ion implanted area, thereby forming an electric field forming space 1106 and a pointed projection 1107 as shown in FIG. 11C.

Figure 11D:
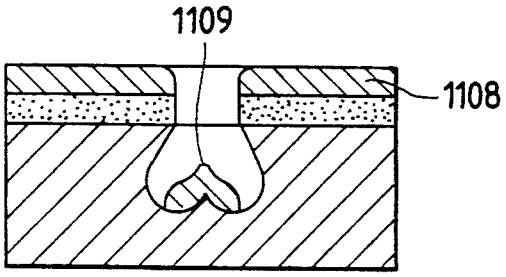

(4) Subsequently a metal, such as Au—Ge alloy, constituting an ohmic contact with N—GaAs was perpendicularly deposited onto the substrate by vacuum evaporation with a thickness of 0.2 μm, and an alloy was formed by a heat treatment for 3 minutes at 400° C. Thus an electrode 1108 and a point-shaped electron emitting part 1109 were formed as shown in FIG. 11D.

In this state electron emission of 50 μA or higher was obtained from the point-shaped electron emitting part 1109 by a voltage application of 40 V between the GaAs substrate 1101 and the electrode 1108.

Figure 11E:
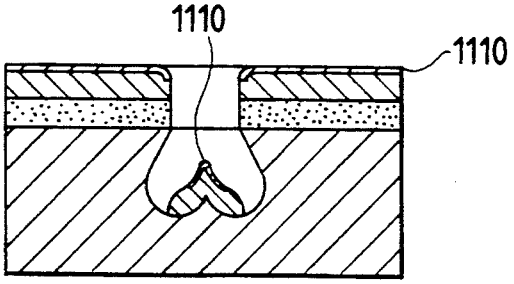

(5) For improving the electron emitting characteristics of this device, $LaB_6$ 1110, as a material of low work function, was perpendicularly deposited by vacuum evaporation with a thickness of 200Å, as shown in FIG. 11E.

The field emission type electron emitting device thus completed showed electron emission of 100 μA or higher from the point-shaped electron emitting part by a voltage application of 30 V between the GaAs substrate and the electrode.

6th embodiment

Figure 12:
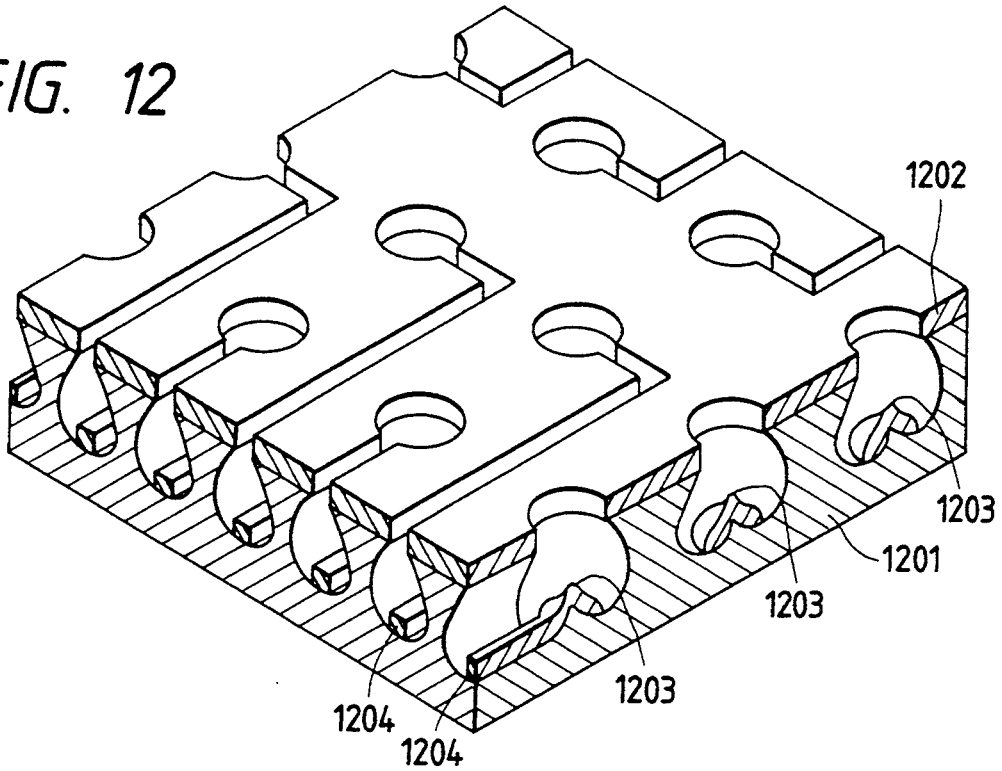
FIG. 12 is a schematic perspective view of a multiple device constituting a sixth embodiment of the present invention.

FIG. 12 is a schematic perspective view of a part of the surface of a field emission type electron emitting device with a multiple structure of the 4th embodiment.

The materials and conditions employed are the same as those shown in FIGS. 7A, 7E–7C and 7G.

In the present embodiment, the electron emitting parts were arranged with a pitch of 1.2 μm, and 4 lines by 15 columns in a unit, and 64 units were formed in a square of 250×250 μm.

An emission current density of 300 A/cm$^2$ could be obtained by a voltage application of 45 V between the electrodes 1202 and all the electron emitting parts 1203.

In the present embodiment, the electrode is integrally constructed while the electron emitting parts are electrically independent, but the electrode may be constructed independently for each electron emitting part, and the electron emitting parts may be connected in common.

7th embodiment

FIGS. 13A–13D are schematic cross-sectional views, and FIGS. 13E–13H are schematic perspective views, showing the method of producing a field emission type electron emitting device of the present embodiment. The cross-sectional views in FIGS. 13A–13D respectively correspond to lines B—B in FIGS. 13E–13H. A substrate 1301 can be composed of an insulating single crystal such as yttrium-iron garnet (YIG) or yttrium-aluminum garnet (YAG), but YIG with crystal orientation (111) is employed in the present embodiment.

Figure 13A:
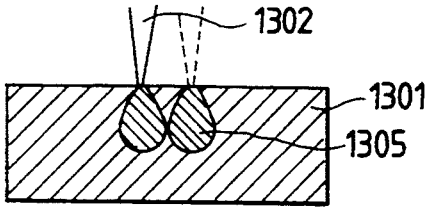
FIGS. 13A, 13B, 13C, 13D, 13E, 13F, 13G and 13H are schematic cross-sectional and perspective views of a field emission type electron emitting device constituting a seventh embodiment of the present invention.
Figure 13B:
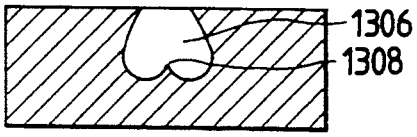
Figure 13C:
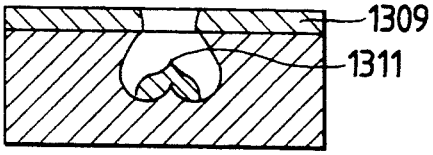
Figure 13D:
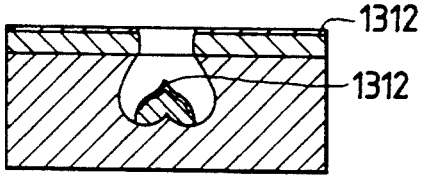
Figure 13E:
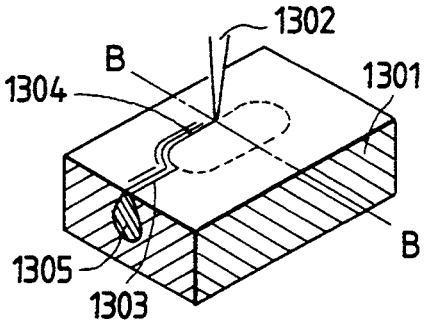

(1) First the YIG substrate was subjected to ion implantation with a $Be^{2+}$ ion beam of 160 keV focused to a spot of 0.1 μmϕ or smaller as shown in FIGS. 13A and 13E. The ion dose was $4\times10^{16}$ ions/cm$^2$ in an area for forming the electrode wiring space (1303), and $2\times10^{16}$ ions/cm$^2$ in an area for forming the electric field forming space (1304). The ion implantation for forming the electric field forming space was conducted along a race track shape having linear portions of 1 μm between semi-circles of a radius of 0.2 μm at a predetermined position. The implanted Be ions were scattered in the substrate 1301, thus forming a waterdrop-shaped implanted area 1305 as shown in FIG. 13A.

Figure 13F:
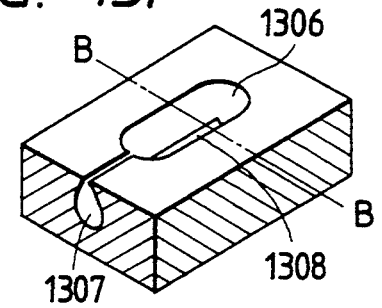
Figure 13G:
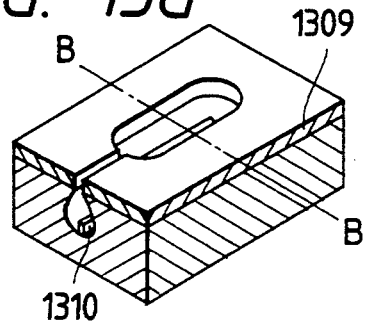

(2) Then the substrate was immersed in phosphoric acid at room temperature to selectively etch off said implanted area, thereby forming, as shown in FIGS. 13B and 13F, an electric field forming space 1306, an electrode wiring space 1307 and a pointed projection 1308 at a depth of 0.5 μm from the surface of the substrate in said position.

(3) Subsequently tungsten was perpendicularly deposited by vacuum evaporation in a thickness of 0.2 μm on the surface of the substrate, thereby simultaneously forming an electrode 1309, a wiring 1310 and a line-shaped electron emitting part 1311.

In this state an electron emission of 5 mA or higher was obtained by a voltage application of 30 V between the wiring 1310 and the electrode 1309.

Figure 13H:
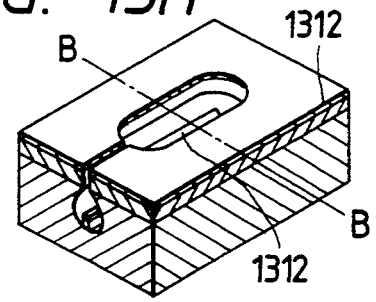

(4) For improving the electron emitting characteristics of this device, $LaB_6$ 1312, as a material of low work function, was perpendicularly deposited by vacuum evaporation in a thickness of 200Å on the surface of the substrate 1301, as shown in FIGS. 13D and 13H.

The field emission type electron emitting device thus completed showed electron emission of 10 mA or higher from the line-shaped electron emitting part, by a voltage application of 25 V between the electrode wiring and the electrode. Thus the surface covering with a material of low work function reduced the required voltage or increased the emission current at a same voltage. In addition to $LaB_6$, said material of low work function can for example be borides such as $SmB_6$ or carbides such as TiC or ZrC. The present embodiment is basically the same as the 4th embodiment, except for the difference in the shape of the electric field forming space 1306. However, because of said difference in shape, the present embodiment provides a considerably stronger electron emission in comparison with the 4th embodiment. The electron emitting device of the present embodiment can also be prepared by the ion beam scanning apparatus explained above.

8th embodiment

Also in the present 8th embodiment, the electric field forming space, seen from above, is oblong as in the 7th embodiment, but the cross section in each step, along the line B—B in FIG. 13H is the same as in the 5th embodiment. Consequently the present embodiment will be explained in the following with reference to FIG. 11.

FIGS. 11A to 11E are schematic cross-sectional views showing the method for producing a field emission type electron emitting device employing N—GaAs semiconductor single crystal doped with Si at $3\times10^{18}$ ions/cm$^2$ as the substrate.

(1) First, a $SiO_2$ film 1102 of a thickness of 0.2 μm, formed by vacuum evaporation on a substrate 1101 as shown in FIG. 11A, was irradiated with an $Au^{2+}$ ion beam 1103 of 80 keV with a dose of $8\times10^{18}$ ions/cm$^2$, focused to a diameter of 0.1 μmϕ, inside a race track shape having linear portions of 1 μm between semi-circles of a radius of 0.2 μm and placed in a predetermined position, and said film was thus removed by sputter-etching.

(2) Then, as shown in FIG. 11B, the substrate was irradiated with a $Si^{2+}$ ion beam 1104 of 160 keV focused to a diameter of 0.1 μmϕ along a trajectory which is 0.05 μm inside said race track shape with a dose of $2\times10^{16}$ ions/cm$^2$ to form a water drop-shaped implanted area 1105.

(3) Then the substrate was immersed in hydrochloric acid heated to 70° C. to selectively etch off the ion implanted area, thereby forming an electric field forming space 1106 and a pointed projection 1107 as shown in FIG. 11C.

(4) Subsequently, a metal such as Au—Ge alloy, constituting an ohmic contact with N—GaAs was deposited onto the substrate by perpendicular vacuum evaporation with a thickness of 0.2 μm, and an alloy was formed by a heat treatment for 3 minutes at 400° C. Thus an electrode 1108 and a line-shaped electron emitting part 1109 were formed as shown in FIG. 11D.

In this state electron emission of 5 mA or higher was obtained from the line-shaped electron emitting part 1109 by a voltage application of 40 V between the GaAs substrate 1101 and the electrode 1108.

(5) For improving the electron emitting characteristics of this device, $LaB_6$ 1110, as a material of low work function, was deposited by perpendicular vacuum evaporation with a thickness of 200Å, as shown in FIG. 11E.

The field emission type electron emitting device thus completed showed electron emission of 10 mA or higher from the line-shaped electron emitting part by a voltage application of 30 V between the GaAs substrate and the electrode. This value is considerably higher than in the 5th embodiment.

9th embodiment

Figure 14:
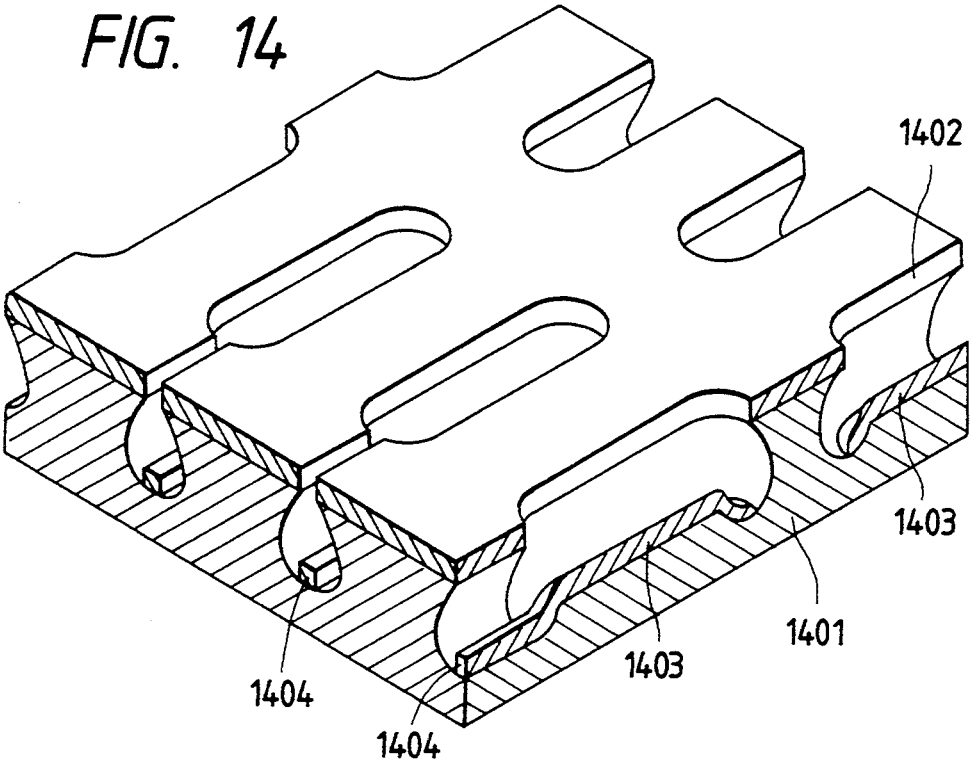
FIG. 14 is a schematic perspective view of a multiple device constituting a ninth embodiment of the present invention.

FIG. 14 is a schematic perspective view of a part of the surface of a field emission type electron emitting device with a multiple structure of the 7th embodiment.

The materials and conditions employed are the same as those shown in FIGS. 13A, 13E–13C and 13G.

In the present embodiment, the electron emitting parts were arranged with a line pitch of 2.0 μm and a column pitch of 1.2 μm, and 2 lines by 8 columns in a unit, and 64 units were formed in a square of 250×250 μm.

An emission current density as high as 8000 A/cm$^2$ could be obtained by a voltage application of 45 V between the electrode 1402 and all the electron emitting part 1403.

In the present embodiment, the electrodes are integrally constructed while the electron emitting parts electrically independent, but the electrodes may be constructed independently for the electron emitting parts, and the electron emitting parts may be constructed in common.

The electron emitting device of the present invention may be applied to a display device, as the electron source of a cathode ray tube, in such a manner that the fluorescent material can be irradiated by the electrons emitted by said device. Also a multiple electron emitting device having elements in a number of pixels can provide so-called flat panel display not requiring deflecting means.

As explained in the foregoing, the electron emitting device of the present invention, being manufacturable with a simple process, can reduce the production cost.

Also the present invention, capable of improving the precision and reproducibility of the size, position, emitter shape etc. of the electron emitting device, can improve the production yield of the device and the uniformity of characteristics thereof, and allows further compactization of the device.

Furthermore, the electron emitting device of the present invention can be arranged with a high density, and can easily provide a large emission current. Consequently, the device of the present invention can be utilized for producing the display apparatus or electron beam drawing apparatus of improved performance.

Furthermore, the present invention allows obtaining a field emission type electron emitting device of an extremely small size, for example less than 3 microns, by irradiating a crystalline material with a focused ion beam and chemically removing the ion implanted area only.

What is claimed is:

1. An electron emitting device comprising:

a substrate, of crystalline material;

an insulating layer on said substrate having a teardrop-shaped hollow part therein, having an aperture through which a substantially conical electrode disposed in said teardrop-shaped hollow part is electrically connected with a conductive layer for electrically powering the conical electrode wherein an emitter is formed at the concave bottom of said teardrop-shaped hollow part, said teardrop-shaped hollow part being in a predetermined position and of a predetermined size; and the conductive layer on said insulating layer having an aperture communicating with the aperture of said hollow part.

2. An electron emitting device according to claim 1, wherein said insulating layer is provided with plural hollow parts, said substantially conical electrode is provided in each of said plural hollow parts, and said conductive layer is provided with plural apertures respectively corresponding to said plural hollow parts.

3. A display apparatus comprising the electron emitting device according to claim 1.

4. An electron beam drawing apparatus comprising the electron emitting device according to claim 1.

5. A field emission electron emitting device according to claim 1, wherein said conical electrode is subjected to a work-function lowering processing.

6. A field emission electron emitting device which comprises:

(i) a substrate of an insulating material, said substrate having a plurality of overlapping waterdrop-shaped hollow portions therein each of said hollow portions having an aperture to the exterior of the substrate, each of said overlapping waterdrop teardrop-shaped hollow portions forming an electric field space;

(ii) a projection at the base of each said overlapping teardrop-shaped hollow portions therein, each said overlapping portions forming an electric field space;

(iii) a point-shaped electron emitter on each said projection; and (iv) a conductive layer on said substrate surface, wherein said conductive layer and each said point-shaped electron emitter forms an electrode for forming an electric field, said conductive layer on said insulating layer having a plurality of apertures respectively corresponding to said teardrop-shaped hollow portions, wherein said apertures of said conductive layer communicate with the respective apertures of said teardrop-shaped hollow portions.

7. A field emission electron emitting device according to claim 6, which comprises being subjected to a treatment for reducing the work function of said point-shaped electron emitting part.

8. A field emission electron emitting device according to claim 7, wherein the work function of said point-shaped electron emitting part is reduced by covering the surface thereof with a material of a lower work function than that of the substrate.

9. A field emission electron emitting device according to claim 6, comprising said electric field forming space and said point-shaped electron emitting part in plural number on a single substrate.

10. A display apparatus using a field emission electron emitting device according to claim 6.

11. An electron beam scribing apparatus using a field emission electron emitting device according to claim 6.

12. A field emission electron emitting device which comprises:

(i) a substrate of a semiconductive or conductive material (i) a substrate of a semiconductive or conductive material (ii) an insulating layer on said substrate having a plurality of overlapping teardrop-shaped hollow portions therein, each of said hollow portions having an aperture to the exterior of the substrate;

(iii) a projection at the base of each said overlapping teardrop-shaped hollow portions;

(iv) a point-shaped electron emitter on each said projection; and (v) a conductive layer on said substrate surface, wherein said conductive layer and each said point-shaped electron emitter forms an electrode for forming an electric field, said conductive layer on said insulating layer having a plurality of apertures respectively corresponding to said teardrop-shaped hollow portions, wherein said apertures of said conductive layer communicate with the respective apertures of said teardrop-shaped hollow portions.

13. A display apparatus using a field emission electron emitting device according to claim 12.

14. An electron beam scribing apparatus using a field emission electron emitting device according to claim 12.

15. A field emission electron emitting device according to claim 12, wherein said conical electrode is subjected to a work function lowering process.

16. A field emission electron emitting device which comprises:

(i) a substrate of an insulating material, said substrate having a plurality of overlapping teardrop-shaped hollow portions therein each of said hollow portions having an aperture to the exterior of the substrate, each of said overlapping teardrop-shaped hollow portions forming an electric field space;

(ii) a line shaped projection at the base of each said overlapping teardrop-shaped hollow portions;

(iii) a line-shaped electron emitter on each said line-shaped projection; and (iv) a conductive layer on said substrate surface, wherein said conductive layer and each said line-shaped electron emitter forms an electrode for forming an electric field, said conductive layer on said insulating layer having a plurality of apertures respectively corresponding to said teardrop-shaped hollow portions, wherein said apertures of said conductive layer communicate with the respective apertures of said teardrop-shaped hollow portions.

17. A field emission electron emitting device according to claim 16, which comprises said line-shaped electron emitting part with a reduced work function.

18. A field emission electron emitting device according to claim 17, wherein the surface of said line-shaped electron emitting part has a cover of a material with a lower work function than that of said substrate.

19. A field emission electron emitting device according to claim 16 comprising a plurality of electric field forming spaces and a plurality of line-shaped electron emitting parts on a single substrate.

20. A display apparatus using a field emission electron emitting device according to claim 16.

21. An electron beam scribing apparatus using a field emission electron emitting device according to claim 16.

22. A field emission electron emitting device which comprises:

(i) a substrate of a semiconductive or conductive material;

(ii) an insulating layer on said substrate having a plurality of teardrop-shaped hollow portions therein;

(iii) a line-shaped projection at the base of each said overlapping teardrop-shaped hollow portions;

shaped electron emitter forms an electrode for forming an electric field, said conductive layer on said insulating layer having a plurality of apertures respectively corresponding to said teardrop-shaped hollow portions, wherein said apertures of said conductive layer communicate with the respective apertures of said teardrop-shaped hollow portions.

* * * * *

UNITED STATES PATENT AND TRADEMARK OFFICE

CERTIFICATE OF CORRECTION

PATENT NO. : 5,391,956

DATED : February 21, 1995

INVENTOR(S) : Nobuo Watanabe et al

It is certified that error appears in the above-indentified patent and that said Letters Patent is hereby corrected as shown below:

ON THE TITLE PAGE

At [56] References Cited

Under "U.S. PATENT DOCUMENTS"

"4,904,895 2/1990 Tsukamoto et al." (2nd occurrence) should be deleted.

Under "OTHER PUBLICATIONS"

"5248-5163." should read --5248-5263.--.

COLUMN 1

Line 47, "p. 5246" should read --p. 5248.--.

COLUMN 3

Line 25, "electron-emitting" should read --electron emitting--.

COLUMN 6

Line 3, ",substantially" should read --substantially--.

COLUMN 9

Line 64, "ogy.," should read --ogy,--.

UNITED STATES PATENT AND TRADEMARK OFFICE

CERTIFICATE OF CORRECTION

PATENT NO. : 5,391,956

DATED : February 21, 1995

INVENTOR(S) : Nobuo Watanabe et al

It is certified that error appears in the above-indentified patent and that said Letters Patent is hereby corrected as shown below:

COLUMN 10

Line 31, "SiO" should read $SiO_2$--.

COLUMN 11

Line 42, ".the" should read --the--.
Line 64, "said" should read --said apparatus--.

COLUMN 12

Line 16, "at" should read --of--.
Line 17, "of" should read --at--.

COLUMN 13

Line 9, "7E-7C" should read --7B-7C--.

COLUMN 14

Line 48, "water drop-" should read --waterdrop- --.

COLUMN 16

Line 26, "waterdrop-" should read --teardrop- --.
Line 29, "waterdrop" should be deleted.
Line 68, "material" should read --material;--.

UNITED STATES PATENT AND TRADEMARK OFFICE

CERTIFICATE OF CORRECTION

PATENT NO. : 5,391,956

DATED : February 21, 1995

INVENTOR(S) : Nobuo Watanabe et al

It is certified that error appears in the above-indentified patent and that said Letters Patent is hereby corrected as shown below:

COLUMN 17

Lines 1 and 2 should be deleted.
Line 38, "line shaped" should read --line-shaped--.

COLUMN 18

Line 18, "claim 16" should read --claim 16,--.
Line 33, "portions;" should read --portions; ¶
(iv) a line-shaped electron emitter on each said line-shaped projection; and
(v) a conductive layer on said substrate surface wherein said conductive layer and each said line- --.

Signed and Sealed this

Eleventh Day of July, 1995

Bruce Lehman

*Attest:*

BRUCE LEHMAN

*Attesting Officer*

*Commissioner of Patents and Trademarks*